US005273720A

United States Patent [19]

Zinke

[11] Patent Number: 5,273,720

[45] Date of Patent: Dec. 28, 1993

[54] FCC STRIPPER WITH SHIFTABLE BAFFLES

[75] Inventor: Randy J. Zinke, Carol Stream, Ill.

[73] Assignee: UOP, Des Plaines, Ill.

[21] Appl. No.: 976,819

[22] Filed: Nov. 16, 1992

[51] Int. Cl.[5] ..... F27B 15/02

[52] U.S. Cl. ..... 422/144; 208/113; 208/153; 208/157; 422/145; 422/214; 422/310

[58] Field of Search ..... 422/139, 143-145, 422/214, 310; 208/113, 153, 157

[56] References Cited

U.S. PATENT DOCUMENTS

| | | | |
|---|---|---|---|
| 2,395,263 | 2/1946 | Foster | 422/142 X |
| 2,440,620 | 4/1948 | Taff | 23/288 |
| 2,440,625 | 4/1948 | Wiemer | 74/275 |
| 2,541,801 | 2/1951 | Wilcox | 196/52 |
| 2,612,438 | 9/1952 | Murphree | 23/288 |
| 2,994,659 | 8/1961 | Slyngstad et al. | 208/113 |
| 3,894,932 | 7/1975 | Owen | 208/74 |
| 4,017,422 | 4/1977 | Gappa et al. | 422/142 X |
| 4,051,013 | 9/1977 | Strother | 208/78 |
| 4,364,905 | 12/1982 | Fahrig et al. | 422/144 |
| 4,414,100 | 11/1983 | Krug et al. | 208/153 |
| 4,419,221 | 12/1983 | Castagnos, Jr. et al. | 208/113 |
| 4,500,423 | 2/1985 | Krug et al. | 208/161 |

*Primary Examiner*—Robert J. Warden
*Assistant Examiner*—Amalia Santiago
*Attorney, Agent, or Firm*—Thomas K. McBride; John G. Tolomei

[57] ABSTRACT

This invention provides an improved apparatus for stripping hydrocarbons from spent catalyst which offers ready access to stripper baffles for inspection and maintenance. The inner baffles move upwardly or downwardly on a conduit that slides over the central riser.

7 Claims, 1 Drawing Sheet

FCC STRIPPER WITH SHIFTABLE BAFFLES

FIELD OF THE INVENTION

This invention relates broadly to hydrocarbon conversion processes and apparatus. More specifically, the invention relates to an arrangement for baffles in an FCC stripper.

BACKGROUND INFORMATION

Fluidized bed catalytic cracking (commonly referred to as FCC) processes were developed during the 1940's to increase the quantity of naphtha boiling range hydrocarbons which could be obtained from crude oil. Fluidized catalytic cracking processes are now in widespread commercial use in petroleum refineries to produce lighter boiling point hydrocarbons from heavier feedstocks such as atmospheric reduced crudes or vacuum gas oils. Such processes are utilized to reduce the average molecular weight of various petroleum-derived feed streams and thereby produced lighter products, which have a higher monetary value than heavy fractions. Though the feed to an FCC process is usually a petroleum-derived material, liquids derived from tar sands, oil shale or coal liquefaction may be charged to an FCC process. Today, FCC processes are also used for the cracking of heavy oil and reduced crudes. Although these processes are often used as reduced crude conversion, use of the term FCC in this description applies to heavy oil cracking processes as well.

The operation of the FCC process is well known to those acquainted with process for upgrading hydrocarbon feedstocks. Differing designs of FCC units may be seen in the articles at page 102 of the May 15, 1972 edition and at page 65 of the Oct. 8, 1973 edition of "The Oil & Gas Journal". Other examples of FCC processes can be found in U.S. Pat. Nos. 4,364,905 (Fahrig et al); 4,051,013 (Strother); 3,894,932 (Owen); and 4,419,221 (Castagnos, Jr. et al) and the other FCC patent references discussed herein.

A majority of the hydrocarbon vapors that contact the catalyst in the reaction zone are separated from the solid particles by ballistic and/or centrifugal separation methods. However, the catalyst particles employed in an FCC process have a large surface area, which is due to a great multitude of pores located in the particles. As a result, the catalytic materials retain hydrocarbons within their pores and upon the external surface of the catalyst. Although the quantity of hydrocarbon retained on each individual catalyst particle is very small, the large amount of catalyst and the high catalyst circulation rate which is typically used in a modern FCC process results in a significant quantity of hydrocarbons being withdrawn from the reaction zone with the catalyst.

Therefore, it is common practice to remove, or strip, hydrocarbons from spent catalyst prior to passing it into the regeneration zone. It is important to remove retained spent hydrocarbons from the spent catalyst for process and economic reasons. First, hydrocarbons that entered the regenerator increase its carbon-burning load and can result in excessive regenerator temperatures. Stripping hydrocarbons from the catalyst also allows recovery of the hydrocarbons as products. The most common method of stripping the catalyst passes a stripping gas, usually steam, through a flowing stram of catalyst, countercurrent to its direction of flow. Such steam stripping operations, with varying degrees of efficiency, remove the hydrocarbon vapors which are entrained with the catalyst and hydrocarbons which are adsorbed on the catalyst.

The efficiency of catalyst stripping has been increased by using a series of baffles in a stripping apparatus to cascade the catalyst from side to side as it moves down the stripping apparatus. Moving the catalyst horizontally increases contact between it and the stripping medium. Increasing the contact between the stripping medium and catalyst removes more hydrocarbons from the catalyst. As shown by U.S. Pat. No. 2,440,625, the use of angled guides for increasing contact between the stripping medium and catalyst has been known since 1944. In these arrangements, the catalyst is given a labyrinthine path through a series of baffles located at different levels. Catalyst and gas contact is increased by this arrangement that leaves no open vertical path of significant cross-section through the stripping apparatus. Further examples of similar stripping devices for FCC units are shown in U.S. Pat. Nos. 2,440,620; 2,612,438; 3,894,932; 4,414,100; and 4,364,905. These references show the typical stripper arrangement having a stripper vessel, a series of baffles in the form of frusto-conical sections that direct the catalyst inward onto a baffle in a series of centrally located conical or frusto conical baffles that divert the catalyst outwardly onto the outer baffles. The stripping medium enters from below the lower baffle in the series and continues rising upward from the bottom of one baffle to the bottom of the next succeeding baffle. Variations in the baffles include the addition of skirts about the trailing edge of the baffle as depicted in U.S. Pat. No. 2,994,659 and the use of multiple linear baffle sections at different baffle levels as demonstrated by FIG. 3 of U.S. Pat. No. 4,500,423. A variation in introducing the stripping medium is shown in U.S. Pat. No. 2,541,801 where a quantity of fluidizing gas is admitted at a number of discrete locations.

The baffle in the strippers operate in a harsh environment. Constant exposure to high-temperature, abrasive catalyst and steam can damage the baffles. Therefore the baffles require frequent inspection and sometimes repair to assure continued proper operation of the stripper.

Inspection and repair of the baffles poses a problem for many stripper baffle arrangements. Operational considerations restrict the spacing between the baffles to promote good contacting between the catalyst and the stripping medium. This same restrictive spacing, particularly in small diameter stripper vessels, limits access to the baffles and complicates inspection or repair. In particularly small stripping vessels additional manways and access opening though the shell of the vessel improve accessibility somewhat, but add to the expense of the vessel and seldom provide unrestricted access to the entire baffle or stripper interior. Nevertheless access to the stripping baffles still remains limited and in some situations can affect the design of the stripper and stripping baffles.

BRIEF SUMMARY OF THE INVENTION

This invention provides a particular arrangement for shiftable stripping baffles. The shiftable baffle design consists of one or more baffles that are secured in the stripper such that the baffle has an attachment that provides one position while the stripper is in operation and a second position that places it clear of the other baffles for inspection or repair. Shifting the baffles temporarily for inspection or repair during shutdown of the FCC stripper frees the design criteria from consideration for access when determining baffle size and spacing and also improves overall accessibility to the baffles.

In one embodiment, this invention is a stripping apparatus for an FCC unit. The invention comprises a vessel having an elongated shape, a principally vertical orientation, a transverse cross-section open to downward catalyst flow, an uppermost end in communication with a source of catalyst particles, and a lowermost end in communication with the a means for withdrawing catalyst particles. A support member extends vertically through the central portion of the vessel. At least one outer baffle has its outer periphery fixed to the inside vessel and an inner periphery that extends inward for at least one-quarter of the vessel radius. At least one inner baffle is located in a central portion of the vessel. Means are provided for supporting the inner grid on the support member in at least two positions.

In another embodiment, this invention is a stripping apparatus for an FCC unit with telescopically supported central stripping baffles. Thus, the invention comprises a vessel having an elongated shape, a principally vertical orientation, a transverse cross-section open to downward catalyst flow, an upper end in communication with a source of catalyst particles, and a lower end in communication with a means for withdrawing catalyst particles. There is a first conduit fixed to the bottom of the vessel that extends vertically through a central portion of the vessel. A second conduit is supported telescopically over the first conduit for slidable movement with respect thereto. A plurality of outer baffles are spaced apart vertically with each outer baffle having an outer diameter fixed to the inside wall of the vessel. A plurality of inner baffles are spaced apart vertically and have an inner diameter fixed to the second conduit and an outer diameter not more than 12 inches less than the inner diameter of the outer baffles. Means are provided for fixing the location of the second conduit in a first locus such that the inner and outer baffles are vertically offset in an alternating arrangement and changing the position of the second conduit such that the inner baffles are movable with respect to the outer baffles.

Other details and embodiments of this invention are set forth in the following detailed description of the invention.

BRIEF DESCRIPTION OF THE DRAWINGS

FIG. 1 depicts an FCC reactor. The FCC reactor consists of an external riser conduit 10 through which a mixture of catalyst and feed enters the reactor from a lower section of the riser (not shown). The catalyst and feed mixture continues upward into an internal portion 12 of the riser from which it exits into a reactor vessel 14. A cyclone separator 16 receives product vapors and catalyst from reactor vessel 14 and removes entrained catalyst particles from the product vapors. A vapor conduit 18 withdraws product from the top of cyclone 16 and the reactor vessel 14. Catalyst separated from the feed in the vessel 14 passes downwardly through the vessel and is joined with catalyst exiting cyclone 16 through a catalyst conduit 20. As the catalyst falls from the cyclone and the vessel it enters a frusto-conical section 22 which opens at its bottom into a stripper or stripping vessel 24.

Figure 1:
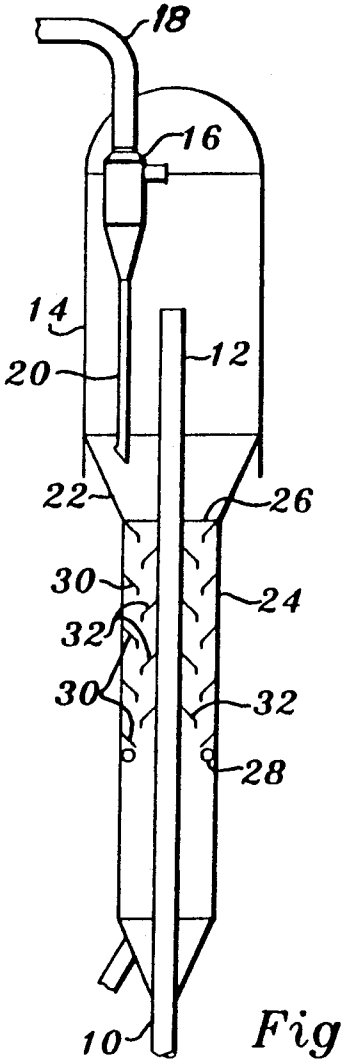
Fig. 1 (PRIOR ART)
FIG. 1 is a reactor vessel containing a prior art stripping arrangement.

Stripping vessel 24 removes additional product vapors from the catalyst entering through opening 26. Steam entering via a distribution ring 28 passes upwardly, countercurrent to the catalyst flowing downwardly through the stripper. As the catalyst enters the stripper, it contacts a series of outer baffles 30 and inner baffles 32. Outer baffles 30 are attached at their outer periphery or outer diameter to the inside of the wall of vessel 24. External baffles 32 extend inwardly for at least one-quarter of the radius of the stripping vessel 24. Inner baffles 32 occupy a central portion of stripping vessel 24 and are attached at their inner periphery to the riser 12. Vertical spacing, between outer baffles 30 and inner baffles 32, maintain the baffles in an alternating arrangement so that catalyst cascades back and forth over the inner to outer baffles as it passes downwardly through the stripping vessel 24. Inner and outer baffles 30 and 32 preferably have a frusto-conical shape and slant downwardly from their point of attachment toward the bottom of stripping vessel 24.

By the method of this invention, means are provided such that baffles 32 can be moved out of the vicinity of baffles 30 during inspection and maintenance. The means for shifting inner baffles out of the vicinity of outer baffles 30 can be provided by any type of support that will securely retain the baffles when in the operational position or the inspection or maintenance position and allow easy movement of the baffles from one position to the other. For instance, the baffles can be slidably supported on any type of a column structure that will allow them to be shifted above or below the outer baffles 30. Such a member can have any cross-sectional area, however, a conduit is a preferred shape for such service. The baffles can slide collectively or individually over the support member. Each inner baffle can be moved to a position that provides ready access to both the inner and outer baffles. Therefore, appropriate means for moving the baffles will allow access to the entire vertical space between adjacent outer baffle 30 and will place the inner baffles in a position such that their entire exterior surface is out of the vicinity of the outer baffles.

Figure 2:
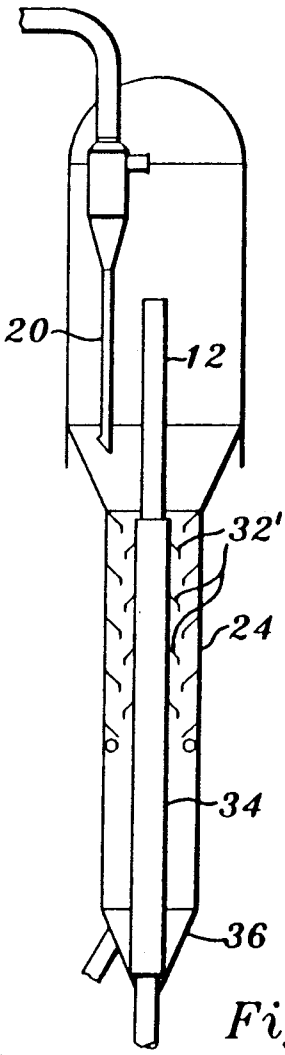
FIG. 2 is a reactor vessel with the stripper arrangement of this invention.

Looking next at FIG. 2, the stripping arrangement depicts stripping baffles supported in accordance with this invention. A conduit 34 having an inner diameter slightly larger than the outer diameter of riser conduit 12 fits telescopically over the riser. Inner stripping baffles 32' are attached along their inner periphery to conduit 34. During operation of the stripper, the lower end of conduit 34 rests at the bottom of a frusto-conical end closure 36 at the lower end of stripping vessel 24.

Figure 3:
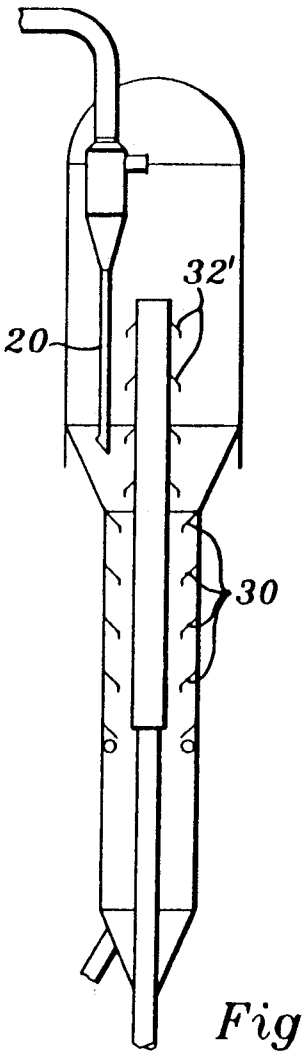
FIG. 3 shows the stripping apparatus of FIG. 2 with the stripping baffles shifted to an alternate location.

During periods of maintenance or inspection, FIG. 3 shows an alternate location for conduit 34 and the inner stripping baffles 32'. As depicted in FIG. 3, conduit 34 has been shifted upwardly to a location where the lowermost inner baffle 32 is above the uppermost baffle 30. When the conduit is shifted upward with the inner baffles 32 to a location in the reactor vessel 14, the entire surface of inner baffles 32 are accessible for inspection or repair work. Similarly, with inner baffles 32 shifted upwardly out of the vicinity of outer baffles 30, outer baffles 30 also are readily accessible for inspection or repair. Any suitable means many be used to hold conduit 34 in the upwardly shifted position such as cables or hooks from the top of the vessel or clips or pins that attach to the riser in conduit 34. Use of a cylindrical conduit, such as 34, has the added advantage of allowing inner stripping baffles 32 to be rotated during repair work.

Figure 4:
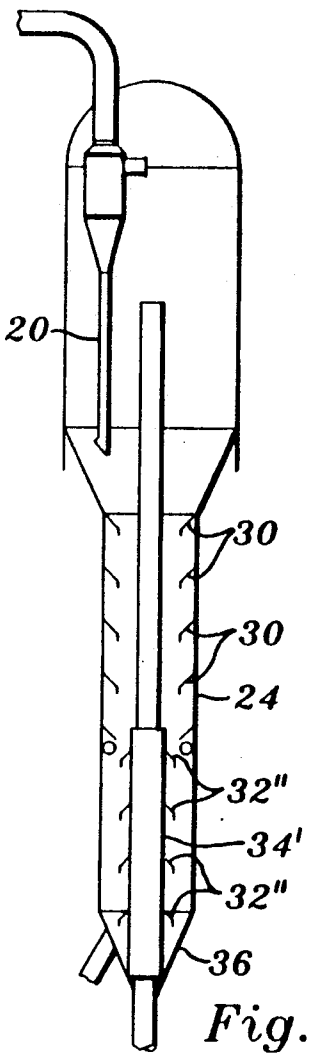
FIG. 4 is an alternate arrangement for the stripping baffles of FIG. 2.

The arrangement of this invention may be used to shift the inner baffles 32 either upwardly or downwardly to provide access to the inner and outer baffles. FIG. 4 shows an arrangement wherein a conduit 34' has been shifted downwardly to place inner baffles 32' out of the vicinity of outer baffles 30. In such an arrangement, means are provided for holding conduit 34' in an upward position during operation so that the inner and outer stripping baffles have the alternate arrangement to cascade catalyst as depicted in FIGS. 1 and 2. When the baffles are shifted to provide access, the bottom of conduit 34' rests on frustoconical end closure 36 at the lower end of stripping vessel 24.

Those skilled in the art are aware of a number of variations that can be practiced in utilizing the arrangement of this invention. For example, the means supporting the inner stripping baffle can consist of several independent sections. Therefore, it is possible to slide individual baffle support sections, consisting of a several separate lengths of conduit each holding a single baffle, over the end of the riser and to an out of the way location for repair out of the vessel or replacement. Moreover, where the length of riser above and below the operational location of the stripping baffles is limited, conduit 30 may consist of two separate sections, one which slides above and the other which slides below the outer stripper baffles for maintenance and inspection.

DETAILED DESCRIPTION OF THE INVENTION

Looking first at a more complete description of the FCC process, the typical feed to an FCC unit is a gas oil such as a light or vacuum gas oil. Other petroleum-derived feed streams to an FCC unit may comprise a diesel boiling range mixture of hydrocarbons or heavier hydrocarbons such as reduced crude oils. It is preferred that the feed stream consist of a mixture of hydrocarbons having boiling points, as determined by the appropriate ASTM test method, above about 232° C. and more preferably above about 288° C. It is becoming customary to refer to FCC type units which are processing heavier feedstocks, such as atmospheric reduced crudes, as residual crude cracking units, or resid cracking units.

An FCC process unit comprises a reaction zone and a catalyst regeneration zone. In the reaction zone, a feed stream is contacted with a finely divided fluidized catalyst maintained at an elevated temperature and at a moderate positive pressure. Contacting of feed and catalyst may take place in a relatively large fluidized bed of catalyst. However, the reaction zones employed in modern FCC units are usually comprised of a vertical conduit, or riser, as the main reaction site, with the effluent of the conduit emptying into a large volume process vessel, which may be referred to as a separation vessel. The residence time of catalyst and hydrocarbons in the riser needed for substantial completion of the cracking reactions is only a few seconds. The flowing vapor/catalyst stream leaving the riser may pass from the riser to a solids-vapor separation device located within the separation vessel or may enter the separation vessel directly without passing through an intermediate separation apparatus. When no intermediate apparatus is provided, much of the catalyst drops out of the flowing vapor/catalyst stream as the stream leaves the riser and enters the separation vessel. One or more additional solids-vapor separation devices, almost invariably a cyclone separator, is normally located within and at the top of the large separation vessel. The products of the reaction are separated from a portion of catalyst which is still carried by the vapor stream by means of the cyclone or cyclones and the vapor is vented from yhe cyclone and separation zone. The spent catalyst falls downward to a lower location within the separation vessel. The stripper may comprise a lower part of the reaction zone (or separation vessel) or spent catalyst may be passed to a stripper separate from the reaction riser and separation vessel. Catalyst is transferred to a separate regeneration zone after it passes through the stripping apparatus.

In an FCC process, catalyst is continuously circulated from the reaction zone to the regeneration zone and then again to the reaction zone. The catalyst therefore acts as a vehicle for the transfer of heat from zone to zone as well as providing the necessary catalytic activity. Catalyst which is being withdrawn from the regeneration zone is referred to as "regenerated" catalyst. As previously described, the catalyst charged to the regeneration zone is brought into contact with an oxygen-containing gas such as air or oxygen-enriched air under conditions which result in combustion of the coke. This results in an increase in the temperature of the catalyst and the generation of a large amount of hot gas which is removed from the regeneration zone as a gas stream referred to as a flue gas stream. The regeneration zone is normally operated at a temperature of from about 593° C. to about 788° C. Additional information on the operation of FCC reaction and regeneration zones may be obtained from U.S. Pat. Nos. 4,431,749; 4,419,221 (cited above); and 4,220,623.

The further description of this invention is presented with reference to the drawings. These depict particular embodiments of the invention and are not intended to limit the generally broad scope of the invention as set forth in the claims.

A baffle may be one of a variety of geometric forms. The drawings show various forms of grids. For example, baffle 30 extends completely around the stripper in a horizontal manner and is attached to the inner surface of the stripper around the entire perimeter of the stripper. Baffle 32 extends completely around the stripper and is attached to the outer surface of the riser along the entire perimeter of the riser 12.

Obviously, the horizontally projected area of each baffle must fall far short of covering the entire annular area to permit catalyst flow. The total horizontal projection of any individual grid will usually equal 40 to 80 percent of the transverse cross-section. Collectively, the horizontal projection of the baffles will substantially cover the transverse cross-sectional area. By substantially covering the annular transverse cross sectional area, the baffles increase contact between the catalyst and stripping gas. This baffle arrangement forces the catalyst to move from side-to-side and eliminates any unobstructed vertical flow path for the catalyst or stripping gas. The arrangement of the baffles is described as substantially covering the flow path. To permit later insertion of the riser and inner grid assembly into the stripper, the outside diameter of the inner baffles is made slightly smaller than the inside diameter of the outer baffles. This leaves an open annular space between the baffles. The Figures exaggerate this space which is usually on the order of 2.5 to 5.0 cm. Since the stripping vessel usually has an overall minimum diameter of 1.5 meters, the direct flow area associated with this spacing is insignificant.

What is claimed is:

1. A stripping apparatus comprising:

(a) a vessel having an elongated shape, a principally vertical orientation, a transverse cross-section open to a downward flow of catalyst particles, an uppermost end in communication with a source of catalyst particles and a lowermost end in communication with a means for withdrawing catalyst particles;

(b) a support member extending vertically through a central portion of said vessel;

(c) at least one outer baffle having an outer periphery fixed to the inside of said vessel and an inner periphery extending inwardly for at least one quarter of the vessel radius;

(d) at least one inner baffle located in a central portion of said vessel; and (e) means for slidably supporting said inner baffle on said support member.

2. The apparatus of claim 1 wherein said at least one outer baffle has a frustoconical shape and extends downwardly from the vessel.

3. The apparatus of claim 2 wherein said inner baffle has an at least partially conical shape and an outer diameter substantially equal to an inner diameter of said outer baffle, such that together said inner and outer baffles substantially cover said transverse cross-section.

4. The apparatus of claim 1 wherein said support member is a vertically extended riser conduit.

5. The apparatus of claim 1 wherein said means for slidably supporting said inner baffle comprises a support conduit that slides telescopically over said riser conduit and has said inner baffle attached thereon.

6. A stripping apparatus for stripping fluids from catalyst particles, said apparatus comprising:

(a) a vessel having an elongated shape, a principally vertical orientation, a transverse cross-section open to a downward flow of catalyst particles, an uppermost end in communication with a source of catalyst particles and a lowermost end in communication with a means for withdrawing catalyst particles;

(b) a first conduit fixed to a bottom of said vessel and extending vertically through a central portion of said vessel;

(c) a second conduit telescopically supported over said first conduit for slidable movement with respect thereto;

(d) a plurality of outer baffles spaced apart vertically, with each outer baffle having an outer diameter fixed to said vessel and an inner diameter;

(e) a plurality of inner baffles spaced apart vertically with each inner baffle having an inner diameter fixed to said second conduit and an outer diameter not more than twelve inches less than the inner diameter of said outer baffles; and (f) means for fixing the location of said second conduit in a first locus such the said inner and outer baffles are vertically offset in an alternating arrangement.

7. The apparatus of claim 6 wherein said first conduit has sufficient length to slide said second conduit from said first locus to a second locus wherein all of said inner baffles are above or below all of said outer baffles.

* * * * *